US010856594B2

(12) United States Patent
Smith, IV et al.

(10) Patent No.: US 10,856,594 B2
(45) Date of Patent: Dec. 8, 2020

(54) MAGNETIC ZIPPER

(71) Applicant: Bilio LLC, Oakland, CA (US)

(72) Inventors: H. William Smith, IV, Mill Valley, CA (US); Timothy J. Karjalainen, Fairfax, CA (US); Patrick C. Hill, San Francisco, CA (US); Philip Isaac Oaks, Kensington, CA (US); Elizabeth Susan Baetz, Glenview, IL (US)

(73) Assignee: BILIO LLC, Oakland, CA (US)

( * ) Notice: Subject to any disclaimer, the term of this patent is extended or adjusted under 35 U.S.C. 154(b) by 0 days.

(21) Appl. No.: 16/128,317

(22) Filed: Sep. 11, 2018

(65) Prior Publication Data

US 2019/0075869 A1 Mar. 14, 2019

Related U.S. Application Data

(60) Provisional application No. 62/557,641, filed on Sep. 12, 2017.

(51) Int. Cl.

| | |
|---|---|
| ***A41F 1/00*** | (2006.01) |
| ***A45C 13/10*** | (2006.01) |
| ***A45C 3/00*** | (2006.01) |
| ***A44B 19/16*** | (2006.01) |

(52) U.S. Cl.

CPC ..... *A41F 1/002* (2013.01); *A44B 19/16* (2013.01); *A45C 3/00* (2013.01); *A45C 13/1069* (2013.01); *Y10T 24/32* (2015.01)

(58) Field of Classification Search

CPC ..... A41F 1/002; A44B 19/16; A45C 3/00; A45C 13/1069; A44D 2203/00; H01F 7/0263; Y10T 24/32

See application file for complete search history.

(56) References Cited

U.S. PATENT DOCUMENTS

| | | | | |
|---|---|---|---|---|
| 3,827,019 | A * | 7/1974 | Serbu | A41F 1/002 335/285 |
| 6,301,754 | B1 * | 10/2001 | Grunberger | A41F 1/002 24/303 |
| 2006/0006969 | A1 * | 1/2006 | Cassar | B23Q 3/1546 335/306 |
| 2008/0256979 | A1 * | 10/2008 | Okamura | A44C 5/2071 63/3.1 |

* cited by examiner

*Primary Examiner* — Robert Sandy
*Assistant Examiner* — Michael S Lee
(74) *Attorney, Agent, or Firm* — Dergosits & Noah LLP

(57) ABSTRACT

A magnetic zipper includes two elongate units, each attached to edges of material. One elongate unit includes a series of magnets positioned within a tube. The other elongate unit includes a ferromagnetic material that is attracted by the magnetic field of the series of magnets in the other elongate unit. The ferromagnetic material may also be positioned with a tube. The magnetic attraction between the two elongate units allows them to join to bring the edges of material together and be held together by the strength of the magnetic force.

20 Claims, 13 Drawing Sheets

MAGNETIC ZIPPER

CROSS-REFERENCE TO RELATED APPLICATIONS

This application claims priority to U.S. Provisional App. No. 62/557,641, filed on Sep. 12, 2017, entitled, "Magnetic Zipper," which is hereby incorporated by reference.

FIELD

This application is directed to closure devices and, more particularly, to magnetic closure devices.

BACKGROUND

A typical zipper has a distinctive appearance which either complements the look of an article of clothing or is hidden by various uses of flaps and seams. Furthermore, the typical zipper may be opened and closed from the end, only. Thus, there exists a need for a zipper that provides an alternative look and that provides more options for how it may be opened.

DETAILED DESCRIPTION

The embodiments of a magnetic zipper described within provide for an alternative look because each half of the magnetic zipper may be incorporated into a tube of material and attached to the edge of the gap to be closed. The two halves, opposing each other across the gap, may be brought together and joined by the mutually-attractive magnetic force. The tube material may be the same material as that of the surrounding bag or garment or may be chosen from other materials and colors as desired by the designer. In addition, the magnetic zipper may be opened beginning at any point along its length.

Figure 1:
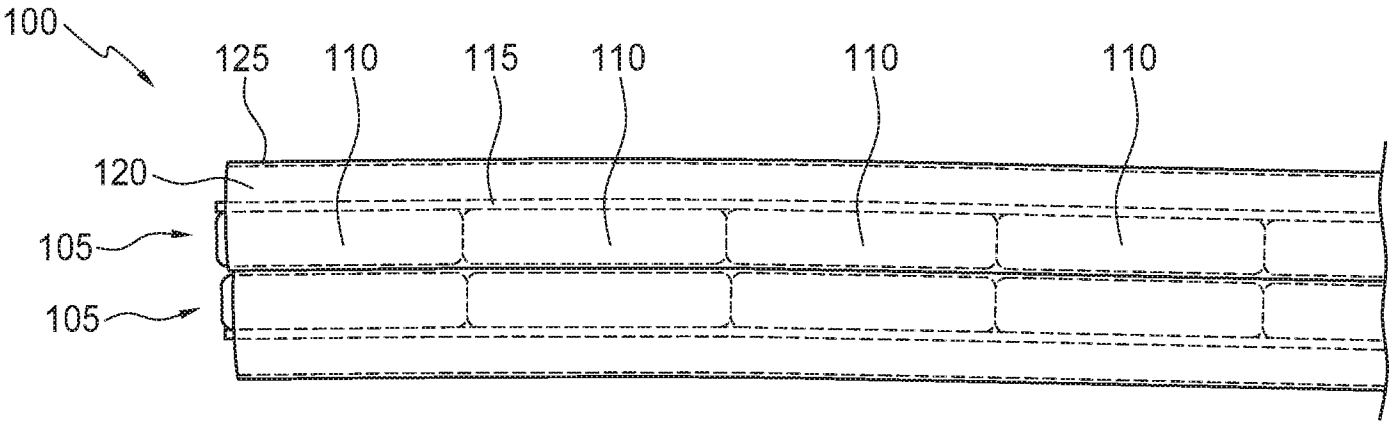
FIG. 1 is a top view depicting a segment of an embodiment of a magnetic zipper.

FIG. 1 is a top view depicting a segment of an embodiment of a magnetic "zipper" 100. In FIG. 1, magnetic zipper 100 includes two zipper halves 105 that are reversibly joined by magnetic force. Zipper halves 105 are opposing sleeves of magnets 110. Each zipper half 105 includes a series of magnets 110, a metal backing 115, a cord 120, and shrink tubing 125. Magnetic zipper 100 may be used to reversibly close the opening of a bag (e.g., bag 130, FIG. 6) with each zipper half 105 attached to either side of an opening. Thus, magnetic zipper 100 may be used in lieu of traditional closure devices, such as pull-tap zippers, buttons, or clasps. Magnetic zipper 110 is a simple, effective, and creative way to replace a pull tab zipper. The figures generally illustrate embodiments of the magnetic zipper as well as various stages of assembly.

Figure 2:
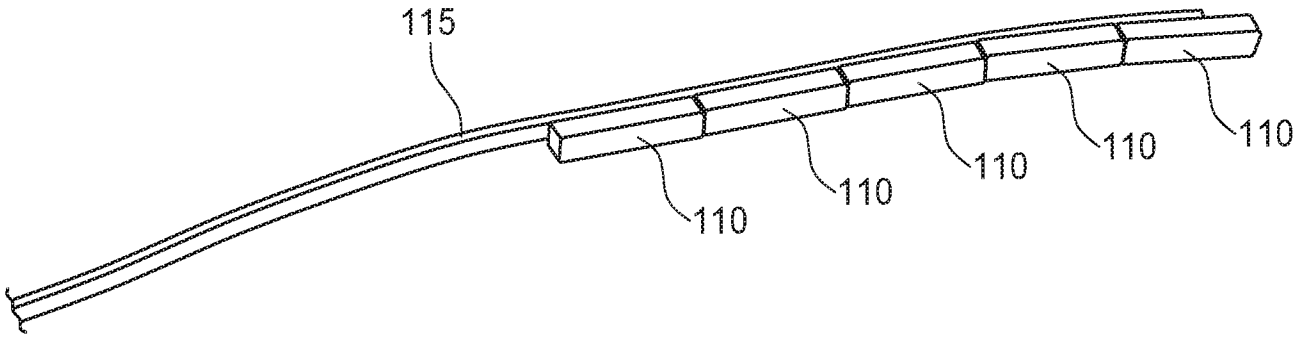
FIG. 2 is a perspective view depicting a subassembly of an embodiment of a magnetic zipper.

In an embodiment, each zipper half 105 includes 73 magnets 110, for a total of 146 for the whole "zipper." Thus, one will realize that the magnetic zipper can be manufactured in shorter or longer sizes. The segment of magnetic zipper 100 in FIG. 1 depicts five magnet pieces stuck together, North to South. In the embodiment, metal backing 115 is a piece of metal that is thin and flexible and attracted to magnets 110 (i.e., the metal is ferromagnetic). Metal backing 115 facilitates the assembly of each zipper half 105 by attracting and holding magnets 110, which allows magnets 110 to be more quickly aligned. FIG. 2 is a perspective view depicting this aspect of metal backing 115. In FIG. 2, five segmented magnets 110 are aligned and attached to metal backing 115.

Figure 3:
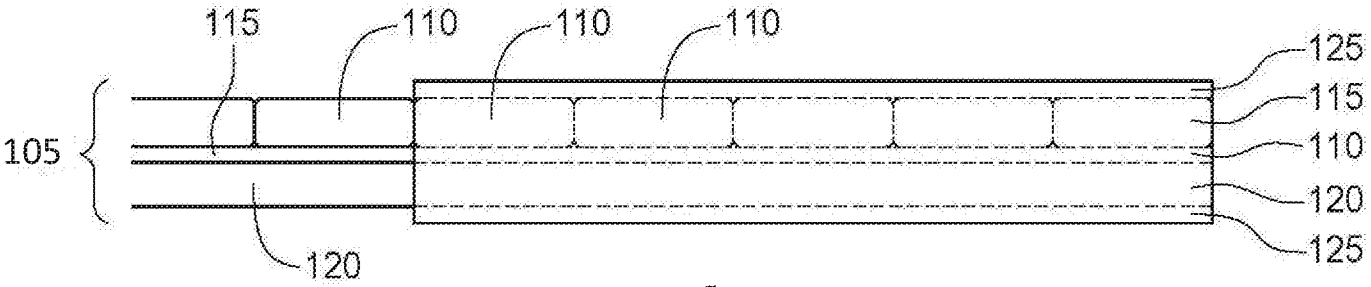
FIG. 3 is a top view depicting a partially-assembled embodiment of a magnetic zipper half.

FIG. 3 is a top view depicting a partially-assembled embodiment of a segment of a magnetic zipper half 105. Cord 120 provides structure to zipper half 105 and may be, e.g., trimmer line or other tubing (solid or hollow) or cord, depending on the support desired. The added structure of cord 120 also helps with the insertion of magnets 110 and metal backing 115 into shrink tubing 125. In the embodiment of FIG. 3, cord 120 is nylon and solid, but other compositions may be used. In embodiments, the color of shrink tubing 125 may be varied as desired. As with cord 120, the brand, size, and color may be varied. In the embodiment, shrink tubing 125 is heat-shrinkable. A beneficial aspect of using shrink tubing is that its thickness decreases with the shrinking. Thus, the magnetically-attracted elements may become closer to each other, which increases the magnetic force of attraction between the elements and improves the holding power of the magnetic zipper.

In FIG. 3 magnetic zipper half 105 is in the process of being assembled, showing two magnetic sections, an associated sections of metal backing 115 and cord 120 not yet inserted into shrink tubing 125. In an embodiment of a process of assembling zipper half 105, magnet segments 110 are aligned and attached to metal backing 115. Metal backing 115 is then set up against a piece of cord 120, which is then (or has already been) cut to the length of metal backing 115. The combination of the metal backing 115 and magnets 110 is then pressed together with cord 120 and guided into heat shrink tubing 125. Heat shrink tubing 125 is then heated, causing it to constrict and further secure the elements within. In the embodiment, magnetic zipper 100 includes two zipper halves 105, which each contain the same elements and are assembled in the same fashion.

Figure 4:
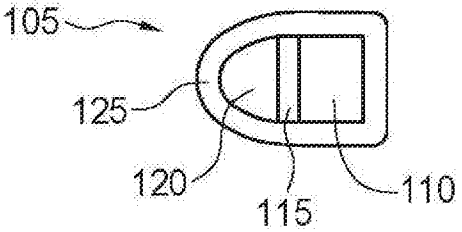
FIG. 4 is an end view depicting a cross-section of the embodiment of a magnetic zipper half of FIG. 3.

FIG. 4 is an end view depicting a cross-section of the embodiment of a magnetic zipper half of FIGS. 1-3. FIG. 4 shows cord 120, metal backing 115, and magnet 110 encased in shrink tubing 125.

Figure 5:
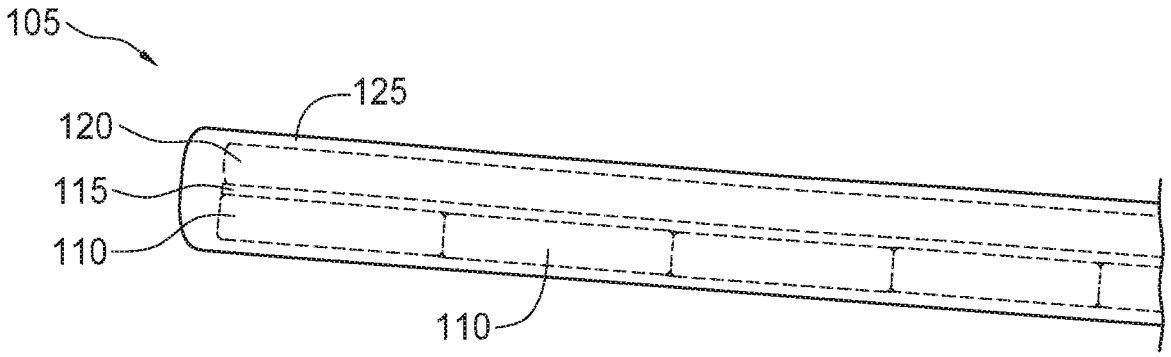
FIG. 5 is a top view depicting the embodiment of a magnetic zipper half of FIG. 3 partially assembled.

FIG. 5 is a top view depicting the embodiment of magnetic zipper half 105 partially assembled. In FIG. 5, shrink tube 125 has not yet been fully shrunk, as indicated by the excess shrink tube at the left end of zipper half 105. Once magnets 110, metal backing 115, and cord 120 are positioned within shrink tubing 125, the assembly is run through a heating tool. During this heating, zipper half 105 may be moved back and forth through the heating tool until it has shrunk around the components within the tube. In an embodiment of the assembly process, the heat shrinking may be performed on a more industrial scale in an oven. The heat shrink tubing is barely visible in FIG. 5 yet shrink tube 125 holds the elements together.

Figure 6:
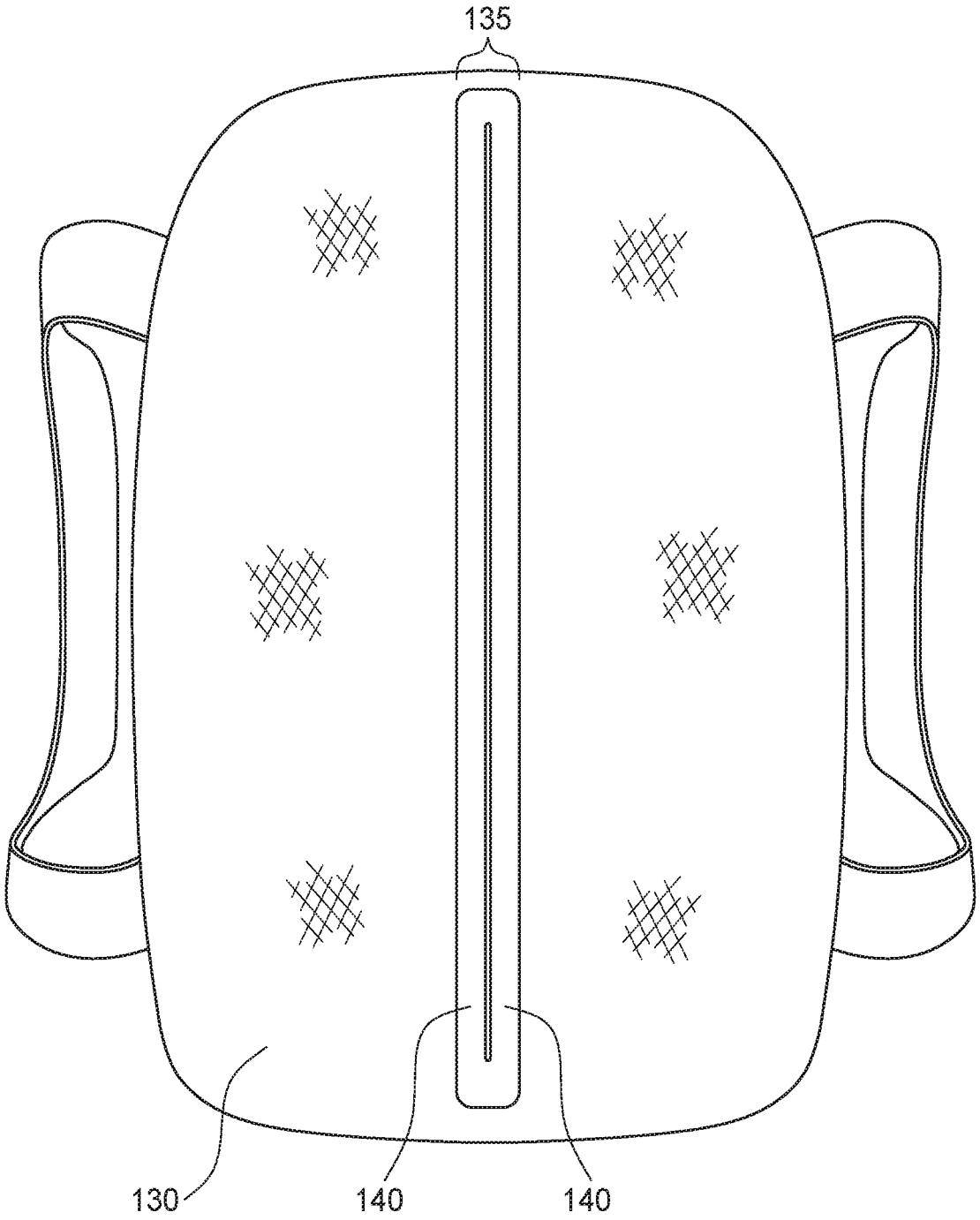
FIG. 6 is a top view depicting a bag incorporating an embodiment of a magnetic zipper.

FIG. 6 is a top view depicting a bag 130 incorporating an embodiment of a magnetic zipper 135. In FIG. 6, magnetic zipper 135 includes two zipper halves (e.g., zipper half 105), each within a zipper halve enclosures 140. Zipper half enclosures 140 are tubes formed at the edges of the opening of bag 130. Each zipper half enclosure 140 includes a zipper half (e.g., zipper half 105) inserted within. Zipper half enclosures 140 are brought together by the attractive magnetic force between the enclosed zipper halves. With one end of a zipper half enclosure left open, the zipper half may be slid into the tube. The relative unobtrusive nature of magnetic zipper 135 makes for a stronger aesthetic than a traditional zipper. Embodiments of the magnetic zipper would work well for a variety of bags, tents, jackets, shades, curtains, and the like. In addition, magnetic zipper 135 may be opened beginning at any point along its length.

Figure 7:
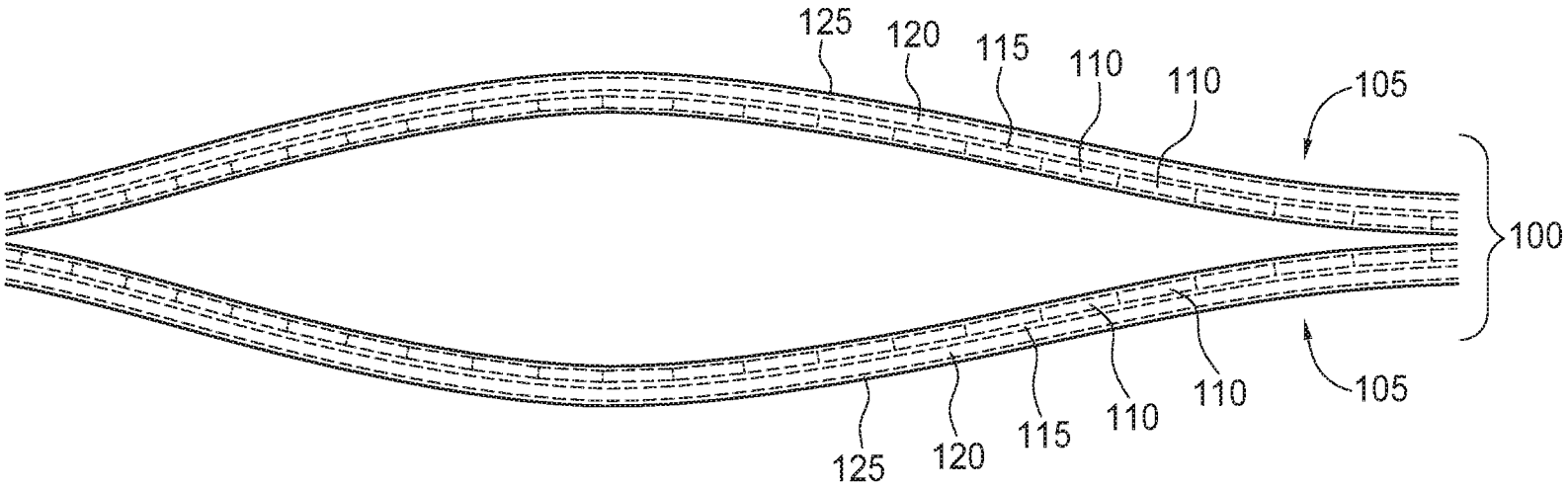
FIG. 7 is a top view depicting the opening of an embodiment of a magnetic zipper.

FIG. 7 is a top view depicting the opening of an embodiment of a magnetic zipper. In FIG. 7, two assembled zipper halves 105 create magnetic zipper 100. Zipper halves 105 are magnetically attracted to each other. In FIG. 7, magnetic zipper 100 is open in the middle. Even open as shown, each half 105 is near to the other half at each end. In the embodiment, because of the magnetic attraction between halves 105, if each half 105 is not restrained in the open position shown, the halves would be drawn toward each other and magnetic zipper 100 would close from the ends (which are already close together) toward to the middle. This embodiment of magnetic zipper 100 does not have a pull tab. In another embodiment, tabs may be affixed to one or both halves 105 to assist with opening zipper 100.

Figure 8:
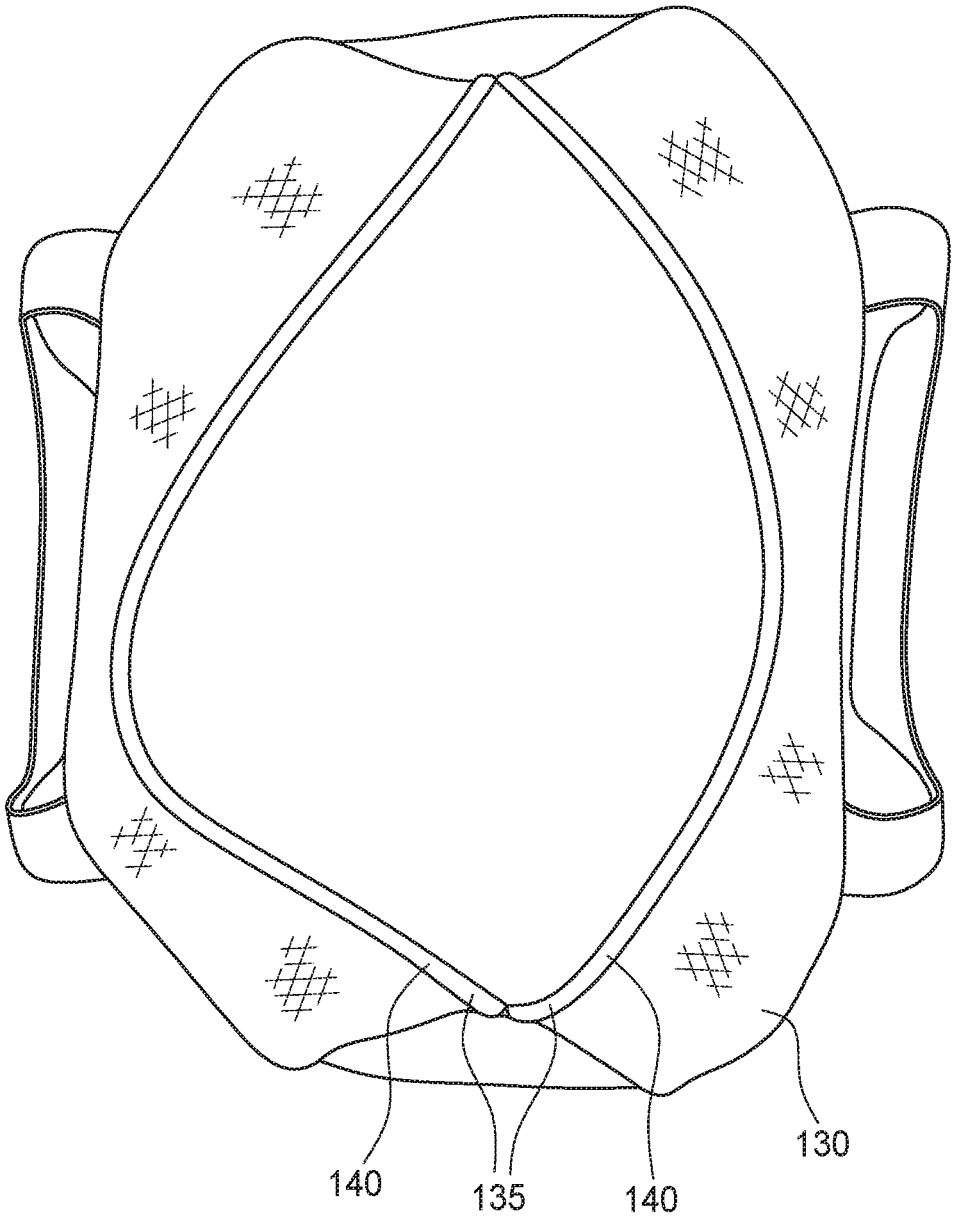
FIG. 8 is a top view depicting an open bag with an embodiment of a magnetic zipper.

FIG. 8 is a top view depicting an open bag 130 with an embodiment of magnetic zipper 135 of FIG. 6. As discussed above regarding FIG. 7, if each half 140 is not restrained in the open position shown, the halves would be drawn toward each other and magnetic zipper 135 would close from the ends (which are already close together) toward to the middle.

The embodiments of FIGS. 1-8 depicted magnets 110 and other elements being contained by shrink tubing 125. However, in other embodiments, the shrink tubing may be replaced by a tube of different material that is flexible enough to allow the zipper to be opened and closed and bend in the process. Such an embodiment may rely on metal backing 115 or cord 120 or both to maintain the positions of magnets 110, rather than on the constrictive effect of a shrink tube. In still another embodiment, the shrink tubing may be replaced by a rigid tube, or sections of rigid tube.

In another embodiment, a first half of a magnetic zipper may be zipper half 105 as described above with regard to FIGS. 1-8, while the corresponding zipper half may be a similarly-size length of substitute material to which a magnet is attracted, such as steel or other ferromagnetic material. In an embodiment, the substitute material may be segmented and sized to complement the magnetic zipper half. In an embodiment, the half with the substitute material may be assembled in the same manner as zipper half 105. For example, magnets 110 could be replace with similarly sized segments of steel.

In an embodiment, metal backing 115 of FIGS. 1-8 may be replaced by a non-ferromagnetic material. Magnets 110 may be attached to the non-ferromagnetic backing. In an embodiment the backing may be adhesive tape. In an embodiment, the magnet segments may be against but not attached to the non-ferromagnetic backing. In an embodiment, the backing may be monofilament or plastic.

In an embodiment, magnets 110 of FIGS. 1-8 may be replaced by a flexible magnetic tape. In an embodiment where magnets 110 have been replaced by a flexible magnetic tape, metal backing 115 may be removed.

The embodiments of FIGS. 1-8 depicted metal backing 115 between magnets 110 and cord 120. In other embodiments, the order of these layers may be changed. For example, magnets 110 may be between metal backing 115 and cord 120.

Figure 9:
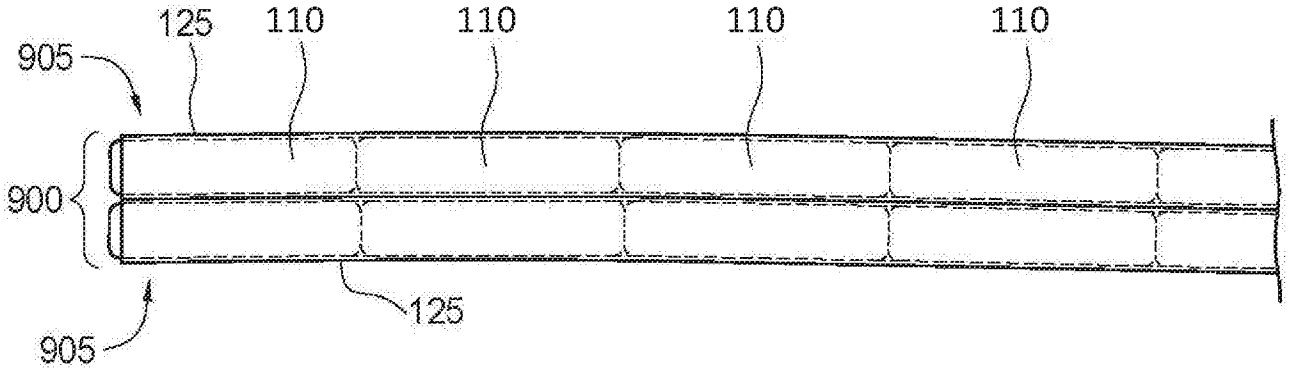
FIG. 9 is a top view depicting an embodiment of a magnetic zipper.

FIG. 9 is a top view depicting an embodiment of a magnetic zipper 900. In FIG. 9, magnetic zipper 900 includes two zipper halves 905 that are reversibly joined by magnetic force. Zipper halves 905 are opposing sleeves of magnets 110. Each zipper half 905 includes a series of magnets 110 within shrink tubing 125. As with zipper 100, magnetic zipper 900 may be used to reversibly close the opening of a bag (e.g., bag 130, FIG. 6) with each zipper half 905 attached to either side of an opening.

Figure 10:
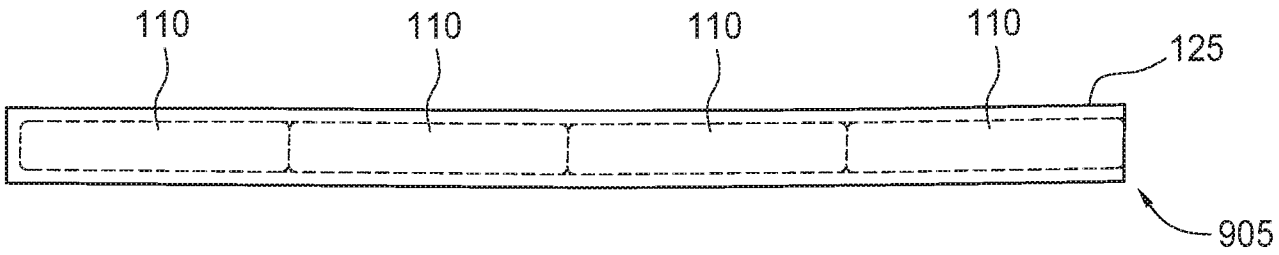
FIG. 10 is a side view depicting an embodiment of a magnetic zipper half.

FIG. 10 is a side view depicting an embodiment of a segment of a magnetic zipper half 905. In an embodiment of a process for assembling zipper half 905, magnets 110 are guided into shrink tube 125. Heat shrink tubing 125 is then heated, causing it to constrict and further secure the magnets within. In the embodiment, magnetic zipper 900 includes two zipper halves 905, which each contain the same elements and are assembled in the same fashion.

Figure 11:
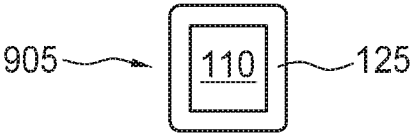
FIG. 11 is an end view depicting the embodiment of a magnetic zipper half of FIG. 11.

FIG. 11 is a cross-sectional view depicting the embodiment of a magnetic zipper half of FIGS. 9-10.

Figure 12:
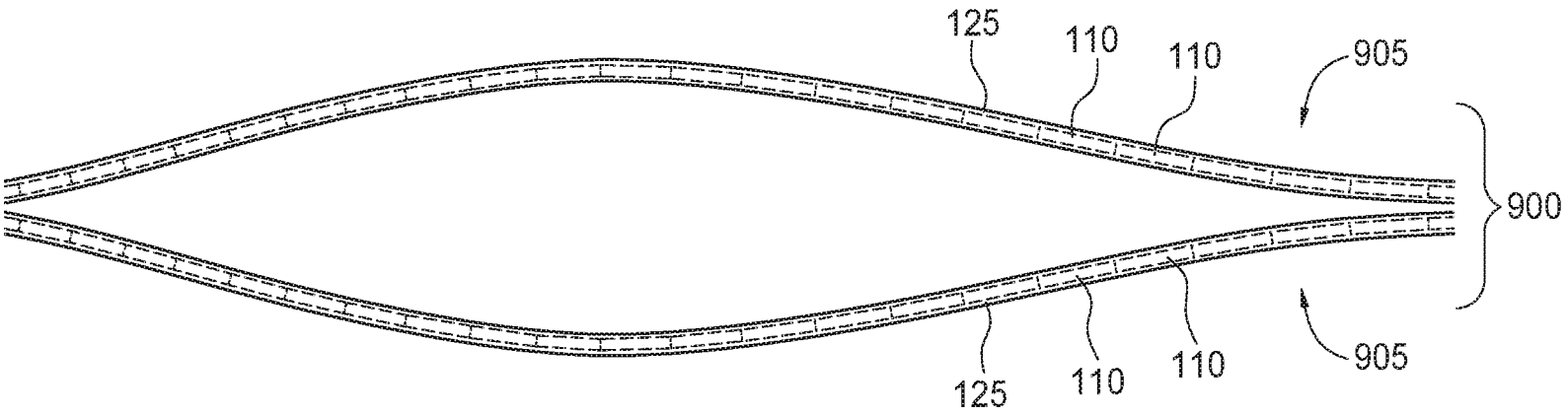
FIG. 12 is a top view depicting the opening of an embodiment of a magnetic zipper.

FIG. 12 is a top view depicting the opening of an embodiment of magnetic zipper 900. In FIG. 12, two zipper halves 905 create magnetic zipper 900. Zipper halves 905 are magnetically attracted to each other. In FIG. 12, magnetic zipper 900 is open in the middle. Even open as shown, each half 905 is near to the other half at each end. In the embodiment, because of the magnetic attraction between halves 905, if each half 905 is not restrained in the open position shown, the halves would be drawn toward each other and magnetic zipper 900 would close from the ends (which are already close together) toward to the middle. This embodiment of magnetic zipper 900 does not have a pull tab. In another embodiment, tabs may be affixed to one or both halves 905 to assist with opening zipper 900.

In an embodiment, a backing similar in form to metal backing 115 or cord 120 (FIGS. 1-8) may be added to the embodiment of FIGS. 9-12. Thus, in the embodiment, the backing may be ferromagnetic or non-ferromagnetic material. Magnets 110 may be attached to the non-ferromagnetic backing. In an embodiment the non-ferromagnetic backing may be adhesive tape. In an embodiment, the magnet segments may be against but not attached to the non-ferromagnetic backing. In an embodiment, the non-ferromagnetic backing may be monofilament or plastic.

Figure 13:
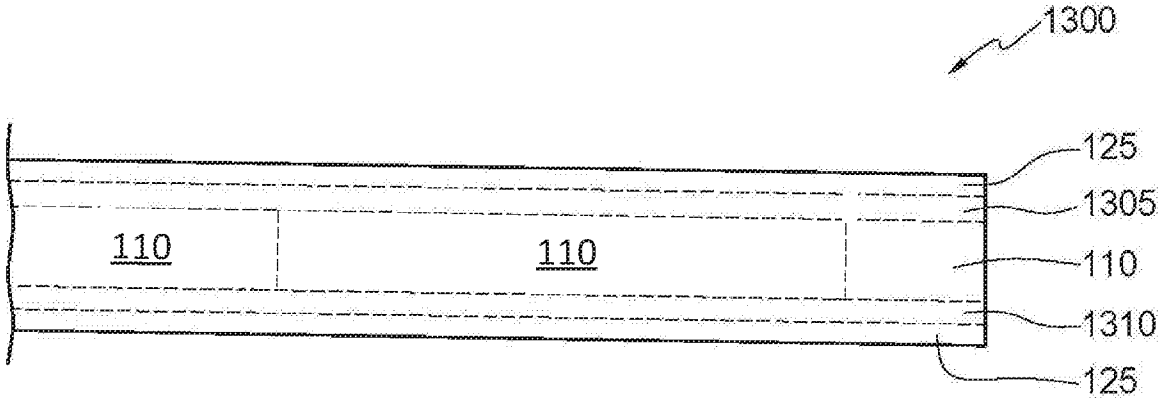
FIG. 13 is a side view depicting a cross-section of an embodiment of a magnetic zipper half.

FIG. 13 is a side view depicting a cross-section of a section of an embodiment of a magnetic zipper half 1300. In FIG. 13, magnets 110 are sandwiched between a shape-retaining ("poseable") monofilament 1305 and a flat layer of plastic layer 1310. In an embodiment, monofilament 1305 and plastic layer 1310 are both 1 mm thick. The monofilament/magnet/plastic sandwich is encased in heat shrink tubing 125. In an embodiment, magnets 110 may be attached to plastic layer 1310 or to monofilament 1305 or both. In an embodiment the attachment may use an adhesive, e.g., adhesive tape. In an embodiment, the magnet segments may be against but not attached to plastic layer 1310 or monofilament 1305.

The embodiment of the magnetic zipper of FIG. 13 may be assembled as described with respect to FIGS. 1-8, except with plastic layer 1310 substituted in for metal backing 115 removed and monofilament 1305 substituted in for cord 120. In an embodiment, since plastic layer 1310 is non-ferromagnetic, magnets 110 may be attached to the non-ferromagnetic backing using an adhesive, e.g., an adhesive tape. In an embodiment, the magnet segments may be against but not attached to the non-ferromagnetic backing.

The embodiment of FIG. 13 depicts magnets 110 between monofilament 1305 and plastic layer 1310. In other embodiments, the order of these layers may be different. For example, monofilament 1305 may be between magnets 110 and plastic layer 120.

Figure 14:
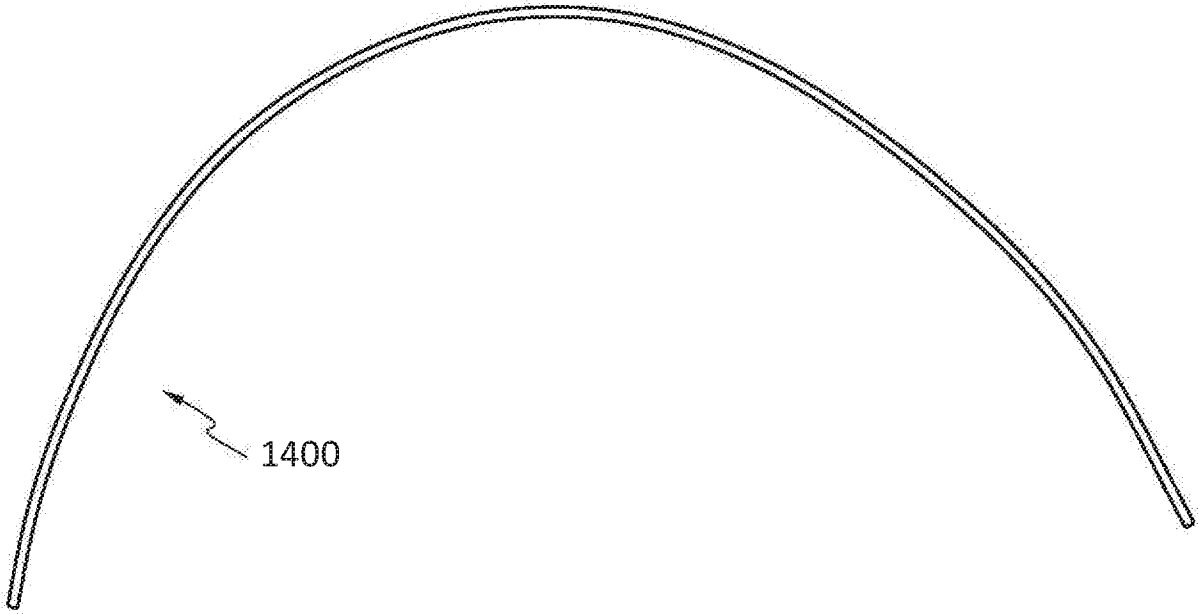
FIG. 14 is a side view depicting an embodiment of a magnetic zipper.

FIG. 14 is a side view depicting an embodiment of a magnetic zipper half 1400. Zipper half 1400 is one-half of an embodiment of the magnetic zipper described with respect to FIG. 15 and FIG. 16. FIG. 14 illustrates the shape-retaining properties the use of poseable monofilament provides to embodiments that incorporate such monofilament. The monofilament provides structure to magnet zipper half 1400 in comparison to the embodiment shown using cord 120 of the embodiment of FIGS. 1-8 or no cord of FIGS. 9-12. FIG. 14 depicts zipper half 1400 as if held at one end with the other end resting on a table surface. As held in such a manner, zipper half 1400 retains an arch because of the use of shape-retaining monofilament. In comparison, embodiments using cord 120 have been found to slouch or sag, potentially to the point where it lay against the table. Thus, magnetic zipper half 1400 and other embodiments incorporating shape-retaining monofilament (e.g., zipper half 1300) may be used to provide structure to an opening, e.g., the opening of bag 130. That is, in an embodiment, zipper half enclosure 140 (one or both) may be filled with magnetic zipper half 1300 or 1400. In such an embodiment, the shape-retaining properties of monofilament 1305 would allow the opening of bag 130 to be bent so that access to the interior was maximized or maintained. To close bag 130 afterward, zipper half enclosures 140 may be brought together and straightened, or bent to match, in the process.

Figure 15:
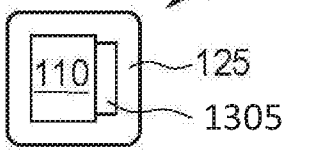
FIG. 15 is an end view depicting an embodiment of a magnetic zipper.

FIG. 15 is an end view depicting a cross-section of the embodiment of a magnetic zipper half of FIG. 14. In FIG. 15, zipper half 1400 includes magnets 110 against a layer of monofilament 1305 and encased in shrink tubing 125. In FIG. 15, the embodiment revises the "stack up" of previous embodiment by placing magnets 110 with monofilament 1305 layer within shrink tubing 125 (without plastic layer 1310 of zipper half 1300). In an embodiment, magnets 110 may be attached to monofilament 1305. In an embodiment the attachment may use an adhesive, e.g., adhesive tape. In an embodiment, the magnet segments may be against but not attached to monofilament 1305.

Regarding the monofilament of zipper half 1300 and 1400, this shape-retaining (or "poseable") material may have various shapes, e.g., it may have flat (rectangular) or circular cross-sections. The properties of such monofilament allow it to be unwound from a roll and straightened, and the monofilament will retain the new shape after the straightening force has been removed. Monofilament may be bent into any number of different shapes, with the monofilament retaining the different shape after the bending force has been removed.

Figure 16:
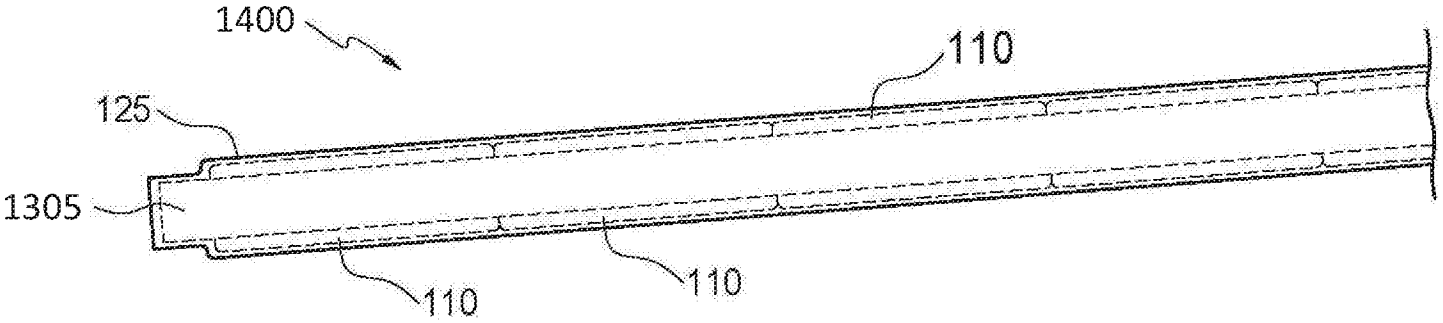
FIG. 16 is a bottom view depicting the embodiment of a magnetic zipper of FIG. 15.

FIG. 16 is a bottom view depicting the embodiment of a magnetic zipper half 1400 of FIGS. 14 and 15. In FIG. 16, monofilament 1305 extends beyond magnets 110 on the left end of FIG. 16, but is still collinear and substantially coextensive with magnets 110.

In embodiments, extending monofilament 1305, plastic layer 1310, cord 120, or shrink tube 125 beyond magnets 110 allows the monofilament, plastic, or cord to be used to physically join together a pair of magnetic zipper halves.

In an embodiment, the metal backing 115 of FIGS. 1-8 may be added to the embodiments of FIGS. 13-16, or may replace plastic layer 1310. In such embodiment, the ferromagnetic properties of the metal backing may be used position the magnets during assembly as discussed with regard to FIGS. 1-8.

The embodiments of FIGS. 1-16 depicted magnets 110 and other elements being contained by shrink tubing 125. However, in other embodiments, the shrink tubing may be replaced by a tube of different material that is flexible enough to allow the zipper to be opened and closed and bend in the process. Such an embodiment may rely on other elements within the tube of different material to maintain the positions of magnets 110 (e.g., metal backing 115, cord 120, monofilament 1305 or plastic layer 1310) rather than on the constrictive effect of a shrink tube. In still another embodiment, the shrink tubing may be replaced by a rigid tube, or sections of rigid tube.

In other embodiments, a first half of a magnetic zipper may be zipper half 1300 or 1400 as described above with regard to FIGS. 1-16, while the corresponding zipper half may be a similarly-size length of substitute material to which a magnet is attracted, such as steel or other ferromagnetic material. In an embodiment, the substitute material may be segmented and sized to complement the magnetic zipper half. In an embodiment, the half with the substitute material may be assembled in the same manner as the corresponding zipper half with magnets 110. For example, with zipper half 1300, the substitute material could be segments of steel sized the same as magnets 110 and the remaining elements of the zipper half could include monofilament 1305, plastic layer 1300 and shrink tubing 125, which could be assembled in the same manner as zipper half 1300.

In embodiments, magnets 110 of FIGS. 1-16 may be replaced by a flexible magnetic tape.

In FIGS. 1-16, magnets 110 are depicted as being rectangular. In other embodiments, magnets 110 may be other shapes, e.g., spheres, cylinders, domes, discs, etc.

In an embodiment, magnets 110 of FIGS. 1-16 are depicted as being in contact with each other. In other embodiments, magnets 110 may be separated from one another by a space. Such separation may provide a zipper half with increased flexibility by allowing each magnet to rotate some amount with respect to adjacent magnets without contacting adjacent magnets.

In the above, any embodiment of a zipper half (e.g., halves 105, 905, 1300, 1400) may be used in zipper half enclosure 140 (FIGS. 6 and 8) so long as there is a magnetic attraction between it and the corresponding zipper half. In other words, any embodiment of a zipper half may be paired with any other embodiment of a zipper half, so long as there is a magnetic attraction between the resulting pair.

In the above, any embodiment of a zipper half may be capped at each end to further retain the magnets or ferromagnetic material, or simply for appearance. The caps may be made of plastic and attached to each end or may be applied as a liquid and allowed to harden or cure in place. For example, each end of zipper half 105 may be dipped in an epoxy and allowed to cure.

It should be understood that the arrangements of the hardware devices illustrated above are but a few of the possible embodiments and that other arrangements are possible. It should also be understood that the various system components (and means) defined by the claims, described above, and illustrated in the various diagrams represent components that are configured to perform the functionality described herein. Moreover, some or all of these other components may be combined, some may be omitted altogether, and additional components can be added while still achieving the functionality described herein. Thus, the subject matter described herein can be embodied in many different variations, and all such variations are contemplated to be within the scope of what is claimed.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

In the description above and throughout, numerous specific details are set forth in order to provide a thorough understanding of the disclosure. It will be evident, however, to one of ordinary skill in the art, that the disclosure may be practiced without these specific details. In other instances, well-known structures and devices are shown in block diagram form to facilitate explanation. The description of the preferred an embodiment is not intended to limit the scope of the claims appended hereto. Further, in the methods disclosed herein, various steps are disclosed illustrating some of the functions of the disclosure. One will appreciate that these steps are merely exemplary and are not meant to be limiting in any way. Other steps and functions may be contemplated without departing from this disclosure.

What is claimed is:

1. An apparatus comprising:

a first elongate unit including a first plurality of magnets within a first heat-shrink tube, the first elongate unit attached to a first material;

a second elongate unit including a ferromagnetic material within a second tube attracted by a magnetic field resulting from the first plurality of magnets, the second elongate unit attached to a second material, the magnetic attraction between the first and second elongate units reversibly joining the first and second elongate units along adjacent surfaces of the first and second elongate units.

2. The apparatus of claim 1, wherein the second tube is a second heat shrink tube and wherein the ferromagnetic material attracted by the magnetic field resulting from the first plurality of magnets includes a second plurality of magnets within the second heat-shrink tube.

3. The apparatus of claim 1, the first elongate unit further including a first backing element between the first plurality of magnets and the first tube, the first backing element running parallel to the first plurality of magnets and the first tube.

4. The apparatus of claim 3, wherein the second tube is a second heat shrink tube and the second elongate unit includes a second backing element, wherein the ferromagnetic material attracted by the magnetic field from the first plurality of magnets includes a second plurality of magnets within the second heat-shrink tube, and wherein the second backing element is positioned between the second plurality of magnets and the second heat-shrink tube, the second backing element running parallel to the second plurality of magnets and the second heat-shrink tube.

5. The apparatus of claim 4, wherein the second backing element has ferromagnetic properties.

6. The apparatus of claim 3, wherein the first backing element is dimensioned about a longitudinal axis with orthogonal first and second axes such that the dimension of the first backing element in the direction of the first axis is greater than the dimension of the first backing element in the direction of the second axis such that the first backing element is relatively more bendable about the first axis than about the second axis, and wherein the first and second elongate units are oriented with respect to one another such that a movement to bring the first and second elongate units together is within a plane defined by the longitudinal and second axes.

7. The apparatus of claim 6, wherein the second tube is a second heat shrink tube and the second elongate unit includes a second backing element, wherein the material attracted by the magnetic field from the first plurality of magnets includes a second plurality of magnets within the second heat-shrink tube, wherein the second backing element is positioned between the second plurality of magnets and the second heat-shrink tube, the second backing element running parallel to the second plurality of magnets and the second elongate unit, and wherein the second backing element is dimensioned about the longitudinal axis with orthogonal first and second axes such that the second backing element is thicker in the direction of the first axis than in the direction of the second axis such that the second backing element is relatively more bendable about the first axis than about the second axis.

8. The apparatus of claim 6, wherein the first elongate unit includes a third backing element, the third backing element running parallel to the first plurality of magnets and the first heat-shrink tube, the third backing element being bendable and dimensioned such that a bending force on the third backing element induces a bend in the first elongate unit, at least part of the bend remaining after the bending force has been removed.

9. The apparatus of claim 8, wherein the second tube is a second heat shrink tube and the second elongate unit includes a second backing element and a fourth backing element, wherein the ferromagnetic material attracted by the magnetic field from the first plurality of magnets includes a second plurality of magnets within the second heat-shrink tube, wherein the second backing element is positioned between the second plurality of magnets and the second heat-shrink tube, the second backing element running parallel to the second plurality of magnets and the second heat-shrink tube, wherein the second backing element is dimensioned about the longitudinal axis with orthogonal first and second axes such that the first backing element is thicker in the direction of the first axis than in the direction of the second axis such that the second backing element is relatively more bendable about the first axis than about the second axis, and wherein the fourth backing element is bendable and dimensioned such that a bending force on the fourth backing element induces a bend in the second elongate unit, at least part of the bend remaining after the bending force has been removed.

10. The apparatus of claim 8, wherein the third backing element includes shape-retaining monofilament.

11. The apparatus of claim 3, wherein the first backing element is bendable and dimensioned such that a bending force on the first backing element induces a bend in the first elongate unit, at least part of the bend remaining after the bending force has been removed.

12. The apparatus of claim 11, wherein the second tube is a second heat shrink tube and the second elongate unit includes a second backing element, wherein the ferromagnetic material attracted by the magnetic field from the first plurality of magnets includes a second plurality of magnets within the second heat-shrink tube, wherein the second backing element is positioned between the second plurality of magnets and the second heat-shrink tube, the second backing element running parallel to the second plurality of magnets and the second heat-shrink tube, and wherein the second backing element is bendable and dimensioned such that a bending force on the second backing element induces a bend in the second elongate unit, at least part of the bend remaining after the bending force has been removed.

13. The apparatus of claim 11, wherein the first backing element includes shape-retaining monofilament.

14. The apparatus of claim 3, wherein the first backing element has ferromagnetic properties.

15. The apparatus of claim 1, wherein the first elongate unit being attached to a first material includes the first elongate unit being incorporated into a tube formed from the first material and the second elongate unit being attached to a second material includes the second elongate unit being incorporated into a tube formed from the second material.

16. The apparatus of claim 1 further comprising first and second caps at ends of the first tube, wherein the second elongate unit further comprises third and fourth caps at ends of the second tube.

17. An apparatus comprising:

a first elongate unit including a first plurality of magnets and a first backing element within a first tube, the first elongate unit attached to a first material, the first backing element being bendable such that a bending force on the first backing element induces a bend in the first elongate unit, at least part of the bend remaining after the bending force has been removed;

a second elongate unit including a ferromagnetic material attracted by a magnetic field resulting from the first plurality of magnets, the second elongate unit attached to a second material, the magnetic attraction between the first and second elongate units reversibly joining the first and second elongate units along adjacent surfaces of the first and second elongate units.

18. The apparatus of claim 17, wherein the first tube includes a first heat-shrink tube.

19. The apparatus of claim 18, wherein the second elongate unit includes a second heat-shrink tube and a second backing element, wherein the ferromagnetic material attracted by the magnetic field from the first plurality of magnets includes a second plurality of magnets within the second heat-shrink tube, wherein the second backing element is positioned between the second plurality of magnets and the second heat-shrink tube, the second backing element running parallel to the second plurality of magnets and the second heat-shrink tube, and wherein the second backing element is bendable and dimensioned such that a bending force on the second backing element induces a bend in the second elongate unit, at least part of the bend remaining after the bending force has been removed.

20. The apparatus of claim 17, wherein the first backing element includes shape-retaining monofilament.

* * * * *